United States Patent [19]

Thumberger

[11] 4,381,572

[45] May 3, 1983

[54] ADJUSTABLE FOOT BRACE

[76] Inventor: Ollibelle Thumberger, 1031 Belle Ave., Hamilton, Ohio 45015

[21] Appl. No.: 219,232

[22] Filed: Dec. 22, 1980

Related U.S. Application Data

[63] Continuation-in-part of Ser. No. 950,566, Oct. 12, 1978, Pat. No. 4,240,170.

[51] Int. Cl.[3] ..... A47C 20/04; A47C 20/02; A61G 7/06

[52] U.S. Cl. ..... 5/444; 5/508

[58] Field of Search ..... 5/444, 445, 508, 53, 5/53 C, 503–507, 426–430, 443, 80

[56] References Cited

U.S. PATENT DOCUMENTS

| | | | |
|---|---|---|---|
| 998,996 | 7/1911 | Swenson et al. | 5/444 |
| 1,694,095 | 12/1928 | Du Moulin | 5/444 |
| 2,749,196 | 6/1956 | Wolfe | 5/507 |
| 2,878,493 | 3/1959 | Delia | 5/444 |
| 3,523,311 | 8/1970 | Ricke | 5/444 |
| 3,866,251 | 2/1975 | Pounds | 5/444 |
| 4,113,218 | 9/1978 | Linder | 5/507 |

FOREIGN PATENT DOCUMENTS

| | | | |
|---|---|---|---|
| 69701 | 11/1914 | Switzerland | 5/73 |

*Primary Examiner*—Alexander Grosz
*Attorney, Agent, or Firm*—Wood, Herron & Evans

[57] ABSTRACT

An adjustable foot brace connectable to a bed. The adjustable foot brace includes a foot panel or footboard movable between an upper position where the board extends generally transverse to the bed's sides, and a lower stored position in which the footboard is located alongside the bed. The brace is mounted upon a side rail of the bed and is cantilevered out over the bed from the side rail mount. It includes an angularly and longitudinally adjustable bar or arm as a part of the mount, the adjustment of which enables the foot board to be moved or adjusted longitudinally of the bed so as to position the foot board of the brace at varying adjustable distances from the headboard end of the bed.

8 Claims, 4 Drawing Figures

ADJUSTABLE FOOT BRACE

This application is a continuation-in-part of application Ser. No. 950,566, filed Oct. 12, 1978 now U.S. Pat. No. 4,240,170.

This invention relates to beds and more particularly, this invention relates to an adjustable foot brace for a bed.

One of the common problems that a bed patient experiences is that of moving himself back toward the headboard end of the bed after he has slipped from a sitting or reclined position to an undesirable location toward the footboard end of the bed. This is particularly bothersome to a bed patient who spends extended periods of time in bed with his head and shoulders raised by having the headboard end of the bed's mattress partially elevated. Normally, after slipping downwardly in the bed, the bed patient simply uses his hands and feet as best he can in an effort to push himself back toward the bed's headboard end. However, this may prove especially difficult for an elderly patient, or for a patient partially indisposed above the waist, because of the physical exertion required.

Therefore, it has been the primary objective of this invention to provide an improved foot brace for preventing a bed patient from slipping downwardly in the bed to which the brace is attached or for use in aiding a bed patient to push himself back up toward the bed's headboard end from the footboard end.

It has been another objective of this invention to provide an adjustable foot brace for a bed, the brace's foot panel being movable between a storage position located adjacent one of the bed's sides and a use position generally transverse to the bed's sides above the mattress' top surface, the foot brace being adjustable manually relative to the longitudinal axis of the bed.

It has been a further objective of this invention to provide an adjustable foot brace for a bed, the brace's foot panel, when oriented in use position transverse to the bed's sides, being easily adjusted to vary the longitudinal position of the foot panel on the bed.

Still another object of this invention has been to provide a universal type of bed foot brace which may be easily and conveniently mounted upon any style of hospital or conventional bed.

In accord with these objectives, the adjustable foot brace of this invention includes, in preferred form, a bed rail mounting bracket which may be easily and conveniently but removably secured to the side rail of a bed. This mounting bracket pivotally supports a carriage within which there is mounted a longitudinally adjustable support bar. At its upper end, this support bar carries a pivotally adjustable footboard mounted upon a footboard support bracket. This footboard, in addition to being angularly adjustable relative to the bed, is pivotally movable between a use position in which it is located over the bed and a stored position in which it hangs from the support bar alongside the bed.

The primary advantage of the foot brace of the invention is that it provides a relatively inexpensive, universal foot brace which may be easily and conveniently attached to very nearly any style of conventional bed or hospital bed.

Other objectives and advantages of this invention will be more apparent from the following detailed description taken in conjunction with the drawings in which.

Figure 1:
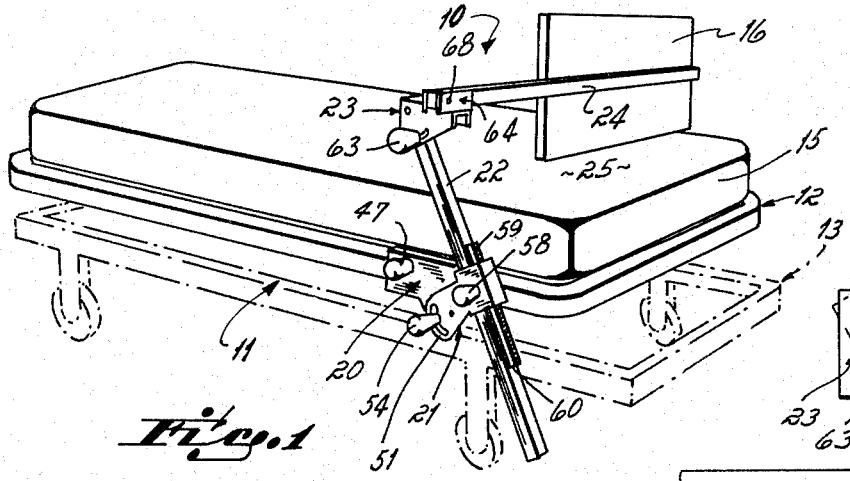
FIG. 1 is a perspective view of a bed having the adjustable foot brace of this invention secured thereto.
Figure 2:
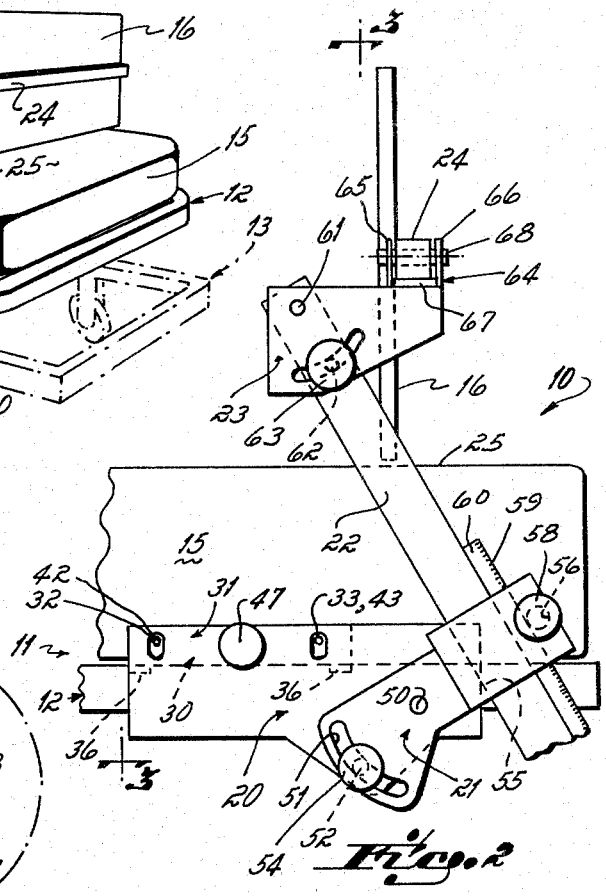
FIG. 2 is an enlarged side elevational view of the adjustable foot brace illustrated in FIG. 1.

Referring to FIG. 1, the adjustable foot brace 10 of this invention is illustrated as applied to or mounted upon a conventional hospital bed 11. The foot brace 10 could as well though be mounted upon any conventional bed, although it is particularly suited for use on a hospital bed.

The hospital bed 11 here illustrated is of the style which has a lower horizontal frame 13 which supports an upper frame 12 for angular adjustment of the headboard and footboard ends of the frame 12 as is conventional in most hospital beds. Between the two frames, there is a mechanism (not shown) for effecting adjustment of the upper frame. A mattress 15 is supported upon the upper frame 12.

The foot brace 10 of this invention functions to adjustably position a footboard 16 across the top of the foot end of the mattress 15. This footboard functions as a brace so as to enable bed patients to place their feet against the board and push so as to position themselves back upwardly toward the headboard end of the mattress. Quite commonly bed patients are prone to slide downwardly toward the footboard end of the mattress whenever the headboard end of the mattress is raised. It then becomes necessary for the patient to reposition himself back toward the other end of the bed, and without the presence of the footboard 16 this can be difficult or even impossible for many patients.

The adjustable foot brace 10 of this invention comprises a bed rail mounting bracket 20, a carriage 21, an adjustment bar 22, a footboard support bracket 23, and footboard 16. The footboard 16 is secured to the supporting bracket 23 by a rail 24.

The carriage 21 is angularly adjustable on the bed rail mounting bracket 20 and the adjustment bar 22 is longitudinally adjustable relative to the carriage. The footboard support bracket 23 is also angularly adjustable relative to the adjustment bar 22. These adjustments enable the adjustment bar 22 to be both angularly and longitudinally adjusted relative to the top surface 25 of the mattress and the footboard 16 to be angularly adjusted relative to the same surface 25.

Figure 4:
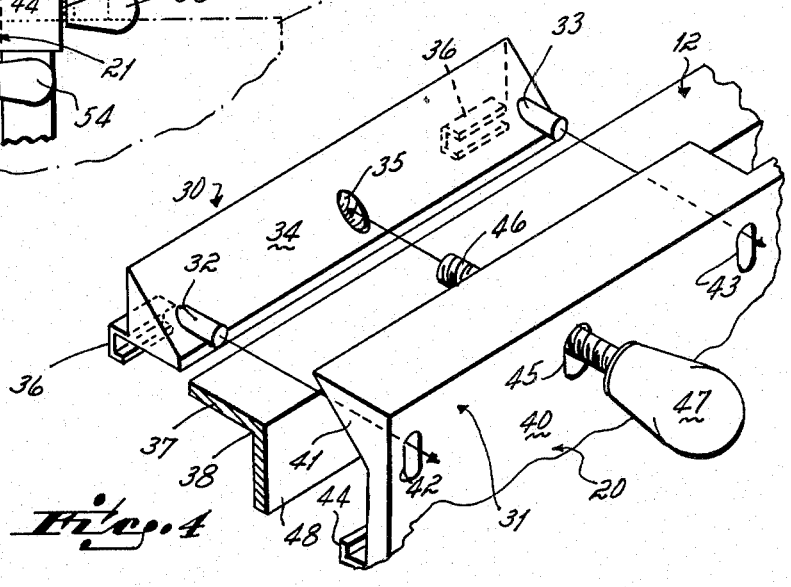
FIG. 4 is an exploded perspective view of the bed rail mounting bracket portion of the foot brace.

The bed rail mounting bracket 20 comprises a two-piece assembly (see FIG. 4), a base block 30 and a carriage supporting block 31. The base block is generally in the shape of a wedge having a pair of locating pins 32, 33 extending from the angled face 34 of the block. A threaded bore 35 extends through the base block parallel to the locating pins 32, 33. On the underside of the base block there are a pair of U-shaped brackets 36, which are adapted to be mounted over the inside edge of the top leg 37 of the angle iron from which the bed frame 12 is constructed.

The carriage supporting block 31 comprises a generally planar face plate section and a wedge shaped attachment section 41 extending from the inside surface of the planar section 40. A hook shaped bracket extends outwardly from the rear of the bracket and is adapted to be received under the lower edge of the vertical leg 4 of the bed rail 12. There are a pair of vertical slots 42, 43 which extend through the wedge shaped section of the carriage supporting block 31. These slots 42, 43 are adapted to receive the locating pins 32, 33. There is also a third slot 45 extending through the attachment section 41 of the carriage supporting block through which a threaded screw 46 extends. At its outer end, this screw 46 has a handle 47 by means of which the screw may be rotated and threaded into the threaded bore 35 in the base block 30.

To assemble the bed rail mounting bracket 20 into the side rail 38, the base block 30 is placed atop the horizontal leg 37 of the bed frame and the carriage supporting block is placed in juxtaposition to the vertical leg 48 of the side rail 38. The locating pins 32, 33 are then inserted into the slots 42, 43 and the screw 45 is threaded into the threaded bore 35 so as to rigidly lock the bed rail mounting bracket to the side rail 38 of the bed frame.

The carriage 21 is pivotally secured to the bed rail mounting bracket 20 by a pivot pin 50. The carriage has an arcuate slot 51 on its lower end through which a screw 52 extends and is threaded into a threaded bore 53 in the carriage supporting block 31. A handle 54 secured to the outer end of the screw 52 facilitates manual rotation of the screw. When the screw is threaded into the threaded bore 53, it locks the carriage in a position of angular adjustment relative to the bed rail mounting bracket 20.

At the end of the carriage 21, remote from the arcuate slot 51, there is a rectangular bore 55 through which the adjustment bar 22 extends. This bore 55 is intersected by a transverse bore (not shown) within which there is located a pinion gear 56 mounted upon a pinion shaft 57. The teeth of this pinion gear engage the teeth 59 of a rack 60 secured to the adjustment bar 22. A handle 58 on the end of the pinion shaft 57, enables the shaft 57 and attched pinion 56, to be manually rotated. Upon rotation of the handle 58, the pinion gear rotates and effects longitudinal movement of the rack 60 and adjustment bar 22 relative to the carriage 21.

The footboard support bracket 23 is pivotally secured to the outer end of the adjustment bar 22 by a pivot pin 61. The bracket 23 has an arcuate slot therein through which there extends a locking screw 62. A handle 63 on the outer end of the screw enables the screw to be manually rotated and threaded into a threaded bore (not shown) in the adjustment bar so as to lock the footboard support bracket in an annular position of adjustment relative to the adjustment bar 22. Fixedly secured to the top of the footboard support bracket, there is a short section of U-shaped channel 64. This section of channel comprises a pair of vertically extending legs 65,66 interconnected by a web 67 which extends between the two legs and is welded or otherwise fixedly secured to the top of the footboard support bracket 23.

Figure 3:
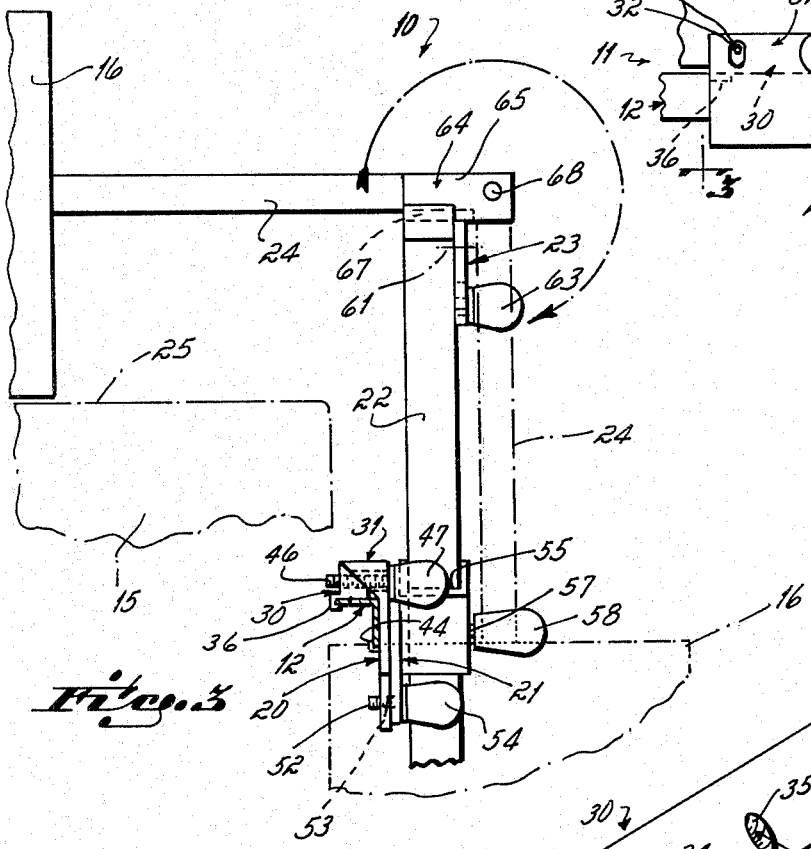
FIG. 3 is a front elevational view, partially broken away, of the foot brace taken on line 3—3 of FIG. 2, and further illustrating in phantom lines, the storage position of the foot panel or footboard.

The footboard 16 is secured to the footboard support bracket 23 by the rail 24. This rail is bolted or otherwise fixedly secured to the rear side of the board 16 by any form of conventional connector (not shown). A pivot pin 68 extends through the end of the rail remote from the board and through the vertical legs of the channel 64. This pivot pin permits the footboard to be located in either of two positions. In the first position, the footboard is located over the top of the mattress as is illustrated in FIG. 1. In the second position, the footboard is rotated 270° from the first position, about the pivot pin 68. In the second position, the footboard and its attached rail 24 hang down vertically from the pivot pin 68 as illustrated in the phantom line position of FIG. 3.

In use, the adjustable foot brace 10 of this invention is attached to a bed by securing the bed rail mounting bracket 20 to the side rail of the bed at any position along the side of the bed. After attachment of the bed rail mounting bracket 20 to the side rail 38 of the bed frame, the adjustment bar 22 is moved angularly and is longitudinally adjusted so as to locate the footboard at whatever longitudinal position of the board, relative to the mattress 15, is most comfortable for the patient. Angular adjustment of the adjustment bar 22 is effected by loosening the handle 54 so as to enable the carriage 21 to be angularly adjusted relative to the bracket 20. After that angular adjustment is effected, the handle 54 is rotated so as to lock the carriage 21 in the adjusted position relative to the bracket 20. The handle 56 is then rotated so as to adjust the bar 22 longitudinally relative to the carriage and thereby position the bottom of the footboard in close adjacency to the top surface 25 of the mattress 15.

After adjustment of the bar 22, the footboard support bracket is angularly adjusted so as to locate the footboard 16 in a vertical plane. This adjustment is effected by rotating the handle 63 so as to unclamp the footboard bracket from between the handle 63 and the adjustment bar 22. After locating the footboard 16 in a vertical plane, the handle 63 is then rotated so as to tighten the attached screw and clamp the fooboard support bracket between the handle 63 and the adjustment bar 22. If any further adjustment of the footboard longitudinally, relative to the mattress 15 is desired, that adjustment is effected by varying the angular and longitudinal position of the adjustment bar 22 relative to the mattress 15 and then resetting the footboard 16 back into a vertical plane relative to the mattress.

If it becomes desirable to move the footboard from over the bed to a storage position, as for example for purposes of making a bed, the footboard may be moved from over the bed by simply swinging it 270° about the pivot pin 68. Alternatively, if the foot brace is to be stored on a semi-permanent basis, the bed rail mounting bracket 20 may be moved to the foot end of the bed frame side rail 38 and the adjustment bar 22 located in the vertical plane. The rail and attached footboard may then be rotated 270° from a position over the mattress 15 to the position illustrated in FIG. 3, wherein the footboard and footboard supporting rail 24 hang downwardly in a vertical plane from the pivot pin 68.

While I have described only a single preferred embodiment of my invention, persons skilled in the art to which it pertains will readily appreciate numerous changes and modifications which may be made without departing from the spirit of my invention. Therefore, I do not intend to be limited except by the scope of the following appended claims.

I claim:

1. An adjustable foot brace adapted for use with a bed, said foot brace comprising a bed rail mounting bracket adapted to be removably secured to the side rail of a bed frame, an angularly adjustable carriage supported from said mounting bracket upon a transversely extending pivot for pivotal adjustment in a vertical plane, a generally vertically extending adjustment bar movable upon said carriage, an angularly adjustable footboard support bracket pivotally secured to the upper end of said adjustment bar, and a footboard pivotally secured to said footboard support bracket, said footboard being movable between a first position in which said footboard extends transversely across said bed to a second position in which said footboard is pivoted approximately 270° in a plane which extends transversely of said bed so that said footboard hangs generally vertically downwardly alongside said bed frame from said footboard support bracket in said second position .

2. The adjustable foot brace of claim 1 in which said bar has rack teeth secured thereon and in which there is a pinion gear rotatably supported from said carriage; said foot brace further including means for rotating said pinion gear so as to effect longitudinal movement of said adjustment bar relative to said carriage.

3. The adjustable foot brace of claim 1 in which said bed rail mounting bracket has an arcuate slot formed therein, and locking means for securing a portion of said carriage in an angular position of adjustment within said slot.

4. The adjustable foot brace of claim 1 in which said footboard support bracket has an arcuate slot therein, and locking means for securing a portion of said footboard in an angular position of adjustment relative to said slot.

5. An adjustable foot brace adapted for use with a bed, said foot brace comprising a bed rail mounting bracket adapted to be removably secured to a longitudinally extending side rail of a bed frame, an angularly adjustable carriage pivotally supported from said mounting bracket upon a pivot pin which extends transversely of said bed frame, a generally vertically extending adjustment bar movably mounted upon said carriage, said adjustment bar being movable both vertically and longitudinally of said bed frame depending upon the angular position of said carriage, an angularly adjustable footboard support bracket pivotally secured to the upper end of said adjustment bar upon a pivot pin which extends transversely of said bed frame, and a footboard secured to said footboard support bracket.

6. The adjustable foot brace of claim 5 in which said bed rail mounting bracket has an arcuate slot formed therein, and locking means for securing a portion of said carriage in an angular position of adjustment within said slot.

7. The adjustable foot brace of claim 6 in which said footboard support bracket has an arcuate slot therein and locking means for securing a portion of said footboard in an angular position of adjustment relative to said slot.

8. The adjustable foot brace of claim 7 in which said adjustment bar has rack teeth secured thereon and in which there is a pinion gear rotatably supported from said carriage; said foot brace further including means for rotating said pinion gear so as to effect longitudinal movement of said adjustment bar relative to said carriage.

* * * * *